US005971532A

United States Patent [19]

Toda

[11] Patent Number: 5,971,532

[45] Date of Patent: Oct. 26, 1999

[54] REPLENISHING INK CARTRIDGE

[75] Inventor: Hajime Toda, Machida, Japan

[73] Assignee: Mitsubishi Pencil Kabushiki Kaisha, Tokyo, Japan

[21] Appl. No.: 08/955,882

[22] Filed: Oct. 22, 1997

[30] Foreign Application Priority Data

Nov. 18, 1996 [JP] Japan ..... 8-322229
Aug. 8, 1997 [JP] Japan ..... 9-214524

[51] Int. Cl.[6] ..... B41J 2/175

[52] U.S. Cl. ..... 347/86; 347/85

[58] Field of Search ..... 347/85, 86, 87, 347/84

[56] References Cited

U.S. PATENT DOCUMENTS 5,673,073 9/1997 Childers et al. ..... 347/86
5,701,995 12/1997 Higuma et al. ..... 206/205

FOREIGN PATENT DOCUMENTS 7-1744 6/1995 Japan .
8-67012 3/1996 Japan .
9-39263 2/1997 Japan .
9-131886 5/1997 Japan .

*Primary Examiner*—N. Le
*Assistant Examiner*—Michael Nghiem
*Attorney, Agent, or Firm*—Darby & Darby

[57] ABSTRACT

A replenishing ink cartridge capable of quickly replenishing a printing cartridge with an ink is provided. The replenishing ink cartridge includes the printing cartridge and a replenishing cartridge for replenishing the printing cartridge with the ink. An ink absorber made of a porous body or fiber bundle is stored in an ink storage chamber of a case of the printing cartridge. An ink supply nozzle to be inserted in the ink absorber is arranged in an ink storage portion of the replenishing cartridge, and a substantially funnel-shaped press member which is to come into contact with the surface of the ink absorber is fitted and mounted on the distal end portion of the ink supply nozzle.

8 Claims, 8 Drawing Sheets

REPLENISHING INK CARTRIDGE

BACKGROUND OF THE INVENTION (1) Field of the Invention

The present invention relates to a replenishing ink cartridge capable of quickly replenishing an ink-jet printing ink cartridge (to be referred to as a printing cartridge hereinafter) with an ink.

(2) Description of the Prior Art

Conventionally, when replenishing a printing cartridge, having an ink absorber made of a porous body or fiber bundle stored in an ink storage chamber, with an ink, for example, the ink is directly dropped to the ink absorber through a dropping pipet, or the ink is injected into the ink absorber through a replenishing ink cartridge. The replenishing ink cartridge is constituted by a syringe and an injection needle mounted on the distal end portion of the syringe.

Japanese Patent Application Laid-Open Hei 7 No. 1744, Hei 8 No. 67012, and Hei 9 Nos. 131886 and 39263 disclose ink cartridges of this type.

Conventionally, ink replenishment to a printing cartridge is performed in the above manner and accordingly has problems as follows. First, when ink replenishment is performed by dropping an ink with a dropping pipet, if a large amount of ink is dropped at once or the ink is injected continuously, the ink may overflow before it is absorbed by the ink absorber. Therefore, in replenishment, the ink must be intermittently dropped little by little, requiring a long period of time until completion of the replenishment.

When the ink is injected by using a replenishing ink cartridge, it is done by deeply inserting an injection needle into the ink absorber. The injection needle must be formed such that it can be easily pierced into the ink absorber, i.e., it must be formed to have a small outer diameter and a sharp distal end. If the replenishing ink cartridge is erroneously used, it may damage an user or an article.

SUMMARY OF THE INVENTION

The present invention has been made in view of the conventional problems described above, and has as its object to provide a replenishing ink cartridge capable of safely performing ink replenishment within a short period of time.

According to the present invention, in order to achieve the above object, in a structure for replenishing a printing cartridge with an ink by a replenishing cartridge, an ink absorber made of a porous body or fiber bundle is stored in an ink storage chamber of the printing cartridge, an ink supply nozzle to be inserted in the ink absorber is arranged in an ink wrapping body of the replenishing cartridge, and a substantially funnel-shaped press member which is to come into contact with the ink absorber is arranged at a distal end portion of the ink supply nozzle.

According to the present invention, when the replenishing cartridge is set in the printing cartridge to cause the press member of the ink supply nozzle to come into contact with the ink absorber, and the replenishing cartridge is positioned above, the ink passes through the ink supply nozzle from the ink wrapping body and continuously flows into the ink storage chamber of the printing cartridge. Since the press member surrounds the distal end portion of the ink supply nozzle to protect it, the operator will not get hurt or various types of articles will not be damaged by the distal end portion of the ink supply nozzle.

DESCRIPTION OF THE PREFERRED EMBODIMENTS

The features and advantages of the present invention will be apparent from the following description taken in conjunction with the accompanying drawings. It should be noted that the accompanying drawings are employed merely for the sake of explanation and do not limit the scope of the present invention at all.

Figure 1:
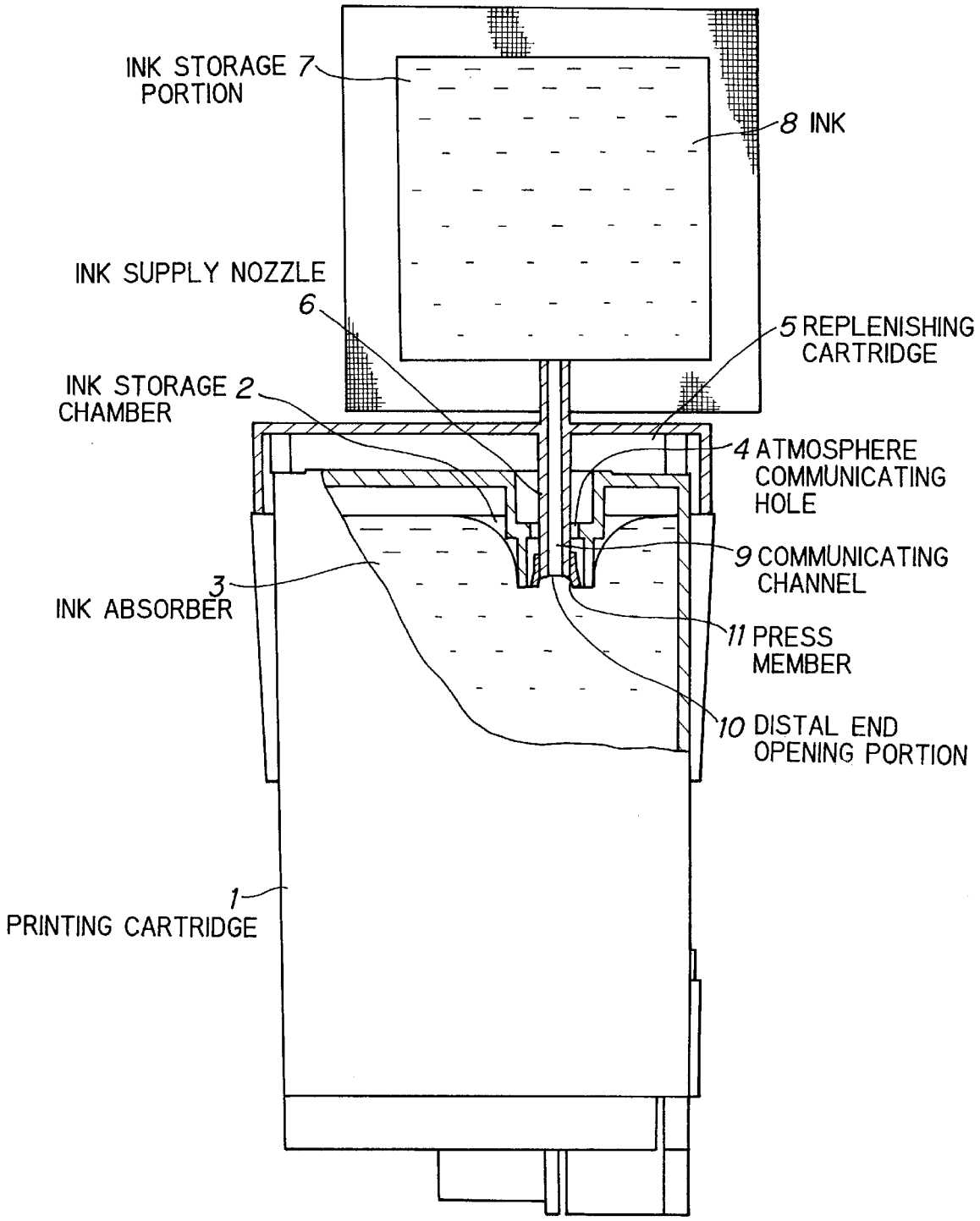
FIG. 1 is a cross sectional view showing a replenishing ink cartridge according to an embodiment of the present invention.

As shown in FIG. 1, a replenishing ink cartridge according to the present invention has a replenishing cartridge 5 for replenishing a printing cartridge 1 with an ink 8. A press member 11 is disposed in the replenishing cartridge 5.

An ink absorber 3 is stored in an ink storage chamber 2 in the case of the printing cartridge 1. An atmosphere communicating hole 4 is formed in a lid in the upper portion of the printing cartridge 1. The atmosphere communicating hole 4 enables communication of outer air to flow into the ink storage chamber 2.

The replenishing cartridge 5 has an ink storage portion 7 for storing the ink 8. An ink supply nozzle 6 is vertically mounted on the lower portion of the ink storage portion 7 to be inserted in it. In this embodiment, since the ink storage portion 7 is made of a flexible bag, as the ink 8 flows out, its volume changes to change its shape, so that its internal pressure is constantly equal to that of the atmosphere. However, even if the ink storage portion 7 is made of a non-flexible material to have a non-deformable structure, as far as an atmosphere communicating hole 4 is formed in part of the ink storage portion 7 and the internal pressure of the ink storage portion 7 does not vary in accordance with the outflow of the ink 8, it can replace the flexible bag described above. As the ink storage portion 7 whose internal pressure varies, a syringe can be used.

A communicating channel 9 is vertically formed in the ink supply nozzle 6. The ink 8 stored in the ink storage portion 7 passes through the communicating channel 9 and is discharged to the outside of the replenishing cartridge 5 through a distal end opening portion 10 of the ink supply nozzle 6. The funnel-shaped press member 11 is fitted and mounted on the distal end opening portion 10 of the ink supply nozzle 6.

Although not shown, an opening/closing plug or the like may be disposed midway along the communicating channel 9 to prevent unnecessary outflow of the ink 8. With this arrangement, the ink 8 can be caused to flow out from the distal end opening portion 10 of the ink supply nozzle 6 only for replenishment, and the ink 8 does not flow while in storage or transportation.

In the above arrangement, to replenish the printing cartridge 1 with the ink 8, first, the replenishing cartridge 5 is set on the printing cartridge 1, the ink supply nozzle 6 is pierced into the atmosphere communicating hole 4, and the press member 11 of the distal end opening portion 10 of the ink supply nozzle 6 is brought into contact with the surface of the ink absorber 3 which is in contact with the atmosphere communicating hole 4. Thereafter, while maintaining this state, the printing cartridge 1 is positioned below and the replenishing cartridge 5 is positioned above. Then, the ink 8 passes through the communicating channel 9 of the ink supply nozzle 6 from the ink storage portion 7 with its own weight and drops into the ink storage chamber 2 of the printing cartridge 1.

Figure 2:
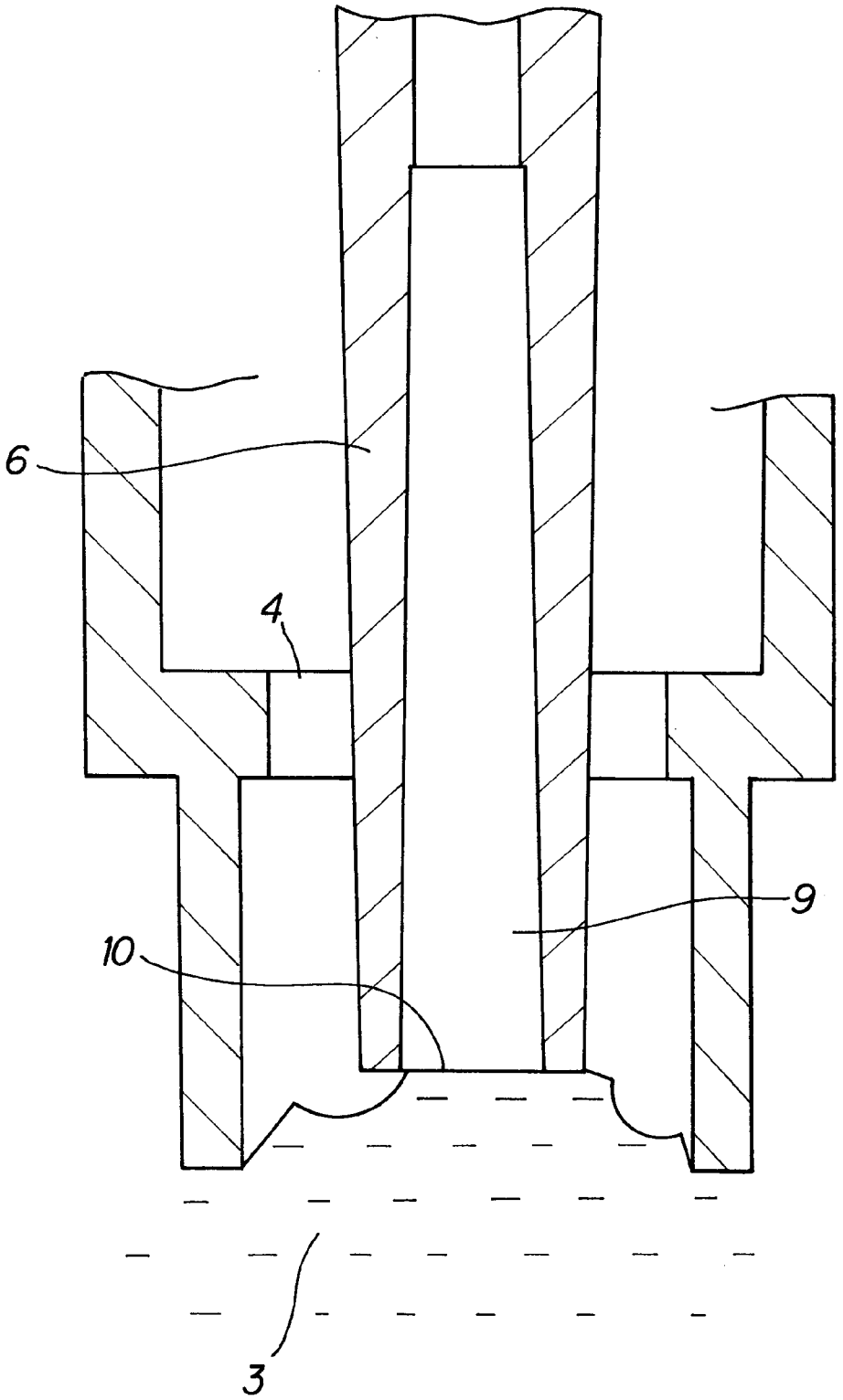
FIG. 2 is a cross sectional view showing problems that arise when a press member is not employed.

During the above replenishing operation, as the press member 11 is fitted and mounted on the distal end opening portion 10 of the ink supply nozzle 6, problems such as soiling the surrounding things, taking a long period of time for the replenishing operation, and hindering the replenishing operation are solved effectively. More specifically, if the press member 11 is not fitted and mounted on the ink supply nozzle 6, a small area around the distal end opening portion 10 comes into contact with the surface of the ink absorber 3 (see FIG. 2). Since the ink absorber 3 is made of a porous body or fiber bundle having a large number of unevenness on its surface, a gap is formed between the ink absorber 3 and the distal end opening portion 10. As a result, the ink 8 flows out through the gap. If the outflow rate is higher than the absorbing rate of the ink absorber 3, the ink 8 stays in the upper part of the ink absorber 3 and passes through the atmosphere communicating hole 4 to flow out to the outside of the printing cartridge 1, soiling the surrounding things with the ink 8.

In view of the above problem, if the distal end opening portion 10 is inserted further deeply to compress the ink absorber 3, then the unevenness on the surface of the ink absorber 3 may be squeezed to a negligible degree. In this case, however, the porosity of only part of the ink absorber 3 which is in contact with the distal end opening portion 10 decreases sharply, and the absorbing rate of the ink 8 decreases accordingly. As a result, a time required until completion of the replenishment prolongs greatly.

In view of the above problem, if the outer diameter of the ink supply nozzle 6 is increased to increase the area of the distal end opening portion 10, the gap formed between the surface of the ink absorber 3 and the distal end opening portion 10 decreases. In this case, however, the gap between the atmosphere communicating hole 4 and the ink supply nozzle 6 also decreases, and outflow of the internal air from the printing cartridge 1 to the outer atmosphere is interfered with. When the ink 8 flows into the ink storage chamber 2, the internal pressure of the ink storage chamber 2 increases, and inflow of the ink 8 to the ink absorber 3 is interfered with. Depending on the composition of the ink absorber 3, although the gap may decrease, the gap cannot sometimes be eliminated by only contact between the ink absorber 3 and the distal end opening portion 10.

Figure 3:
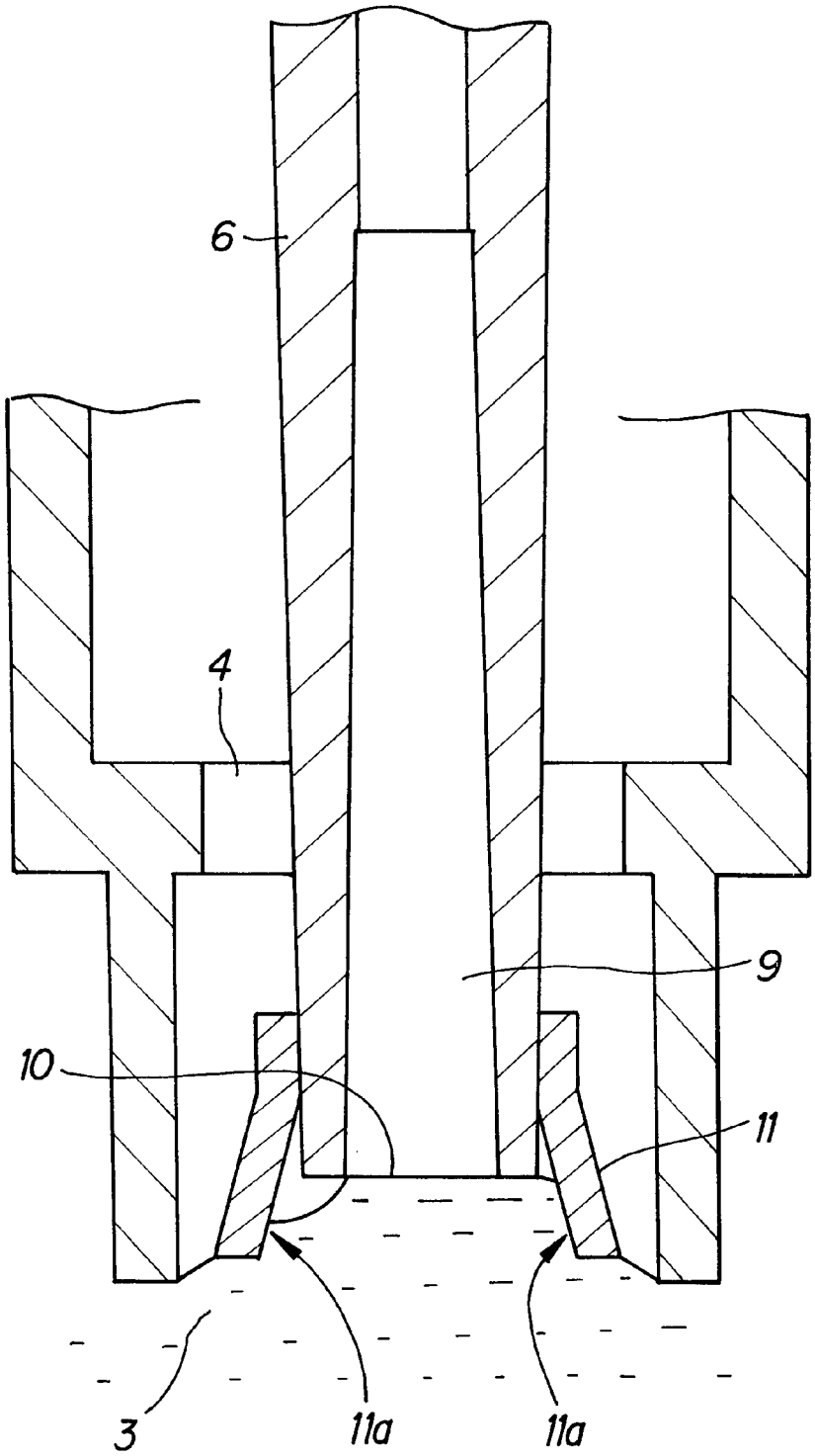
FIG. 3 is an enlarged view of the main part of FIG. 1.

In contrast to this, if the press member 11 is fitted and mounted on the ink supply nozzle 6, when the ink supply nozzle 6 is inserted until its distal end opening portion 10 comes into contact with the ink absorber 3, the distal end edge portion of the press member 11 is inserted further deeply into the ink absorber 3. The porosity of a contact portion 11*a* which is in contact with the press member 11 decreases, and the press member 11 comes into contact with the ink absorber 3 through the contact portion 11*a* on its inner surface having a large area. As the contact portion 11*a* holds part of the ink absorber 3, the gap formed between the surface of the ink absorber 3 and the distal end opening portion 10 is eliminated (regarding this, see FIG. 3). Since an extra pressure does not act on the ink absorber 3 at a portion which is in contact with the distal end portion of the ink supply nozzle 6, a decrease in supply speed of the ink 8 can be prevented effectively.

If the opening angle of the funnel-shaped inner surface of the press member 11 is excessively large, the surface area decreases while the outer radius remains the same; if it is excessively small, the ink absorber 3 and the inner surface of the press member 11 do not come into contact with each other, and the effect described above cannot be expected. Accordingly, the opening angle of the funnel-shaped inner surface of the press member 11 preferably falls within a range of 20° to 90°.

FIGS. 4 to 8 show the second embodiment of the present invention. In the replenishing ink cartridge of this embodiment, a tool set 18, an adapter 28, and a replenishing cartridge 5A are accommodated together in a wrapping case 12, and a printing cartridge 1A is replenished with an ink 8 by using them.

Figure 4:
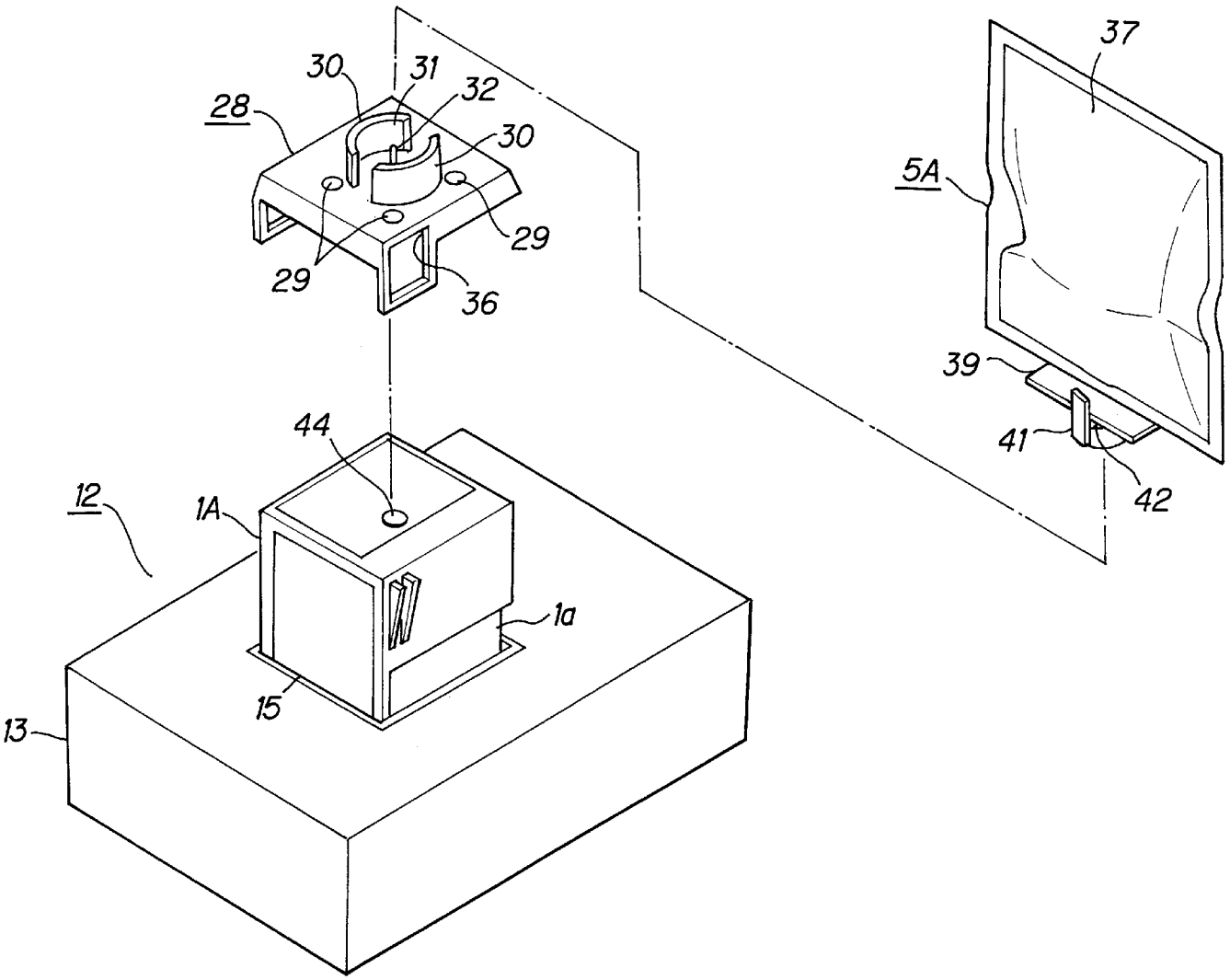
FIG. 4 is a perspective view showing a replenishing ink cartridge according to another embodiment of the present invention.
Figure 6:
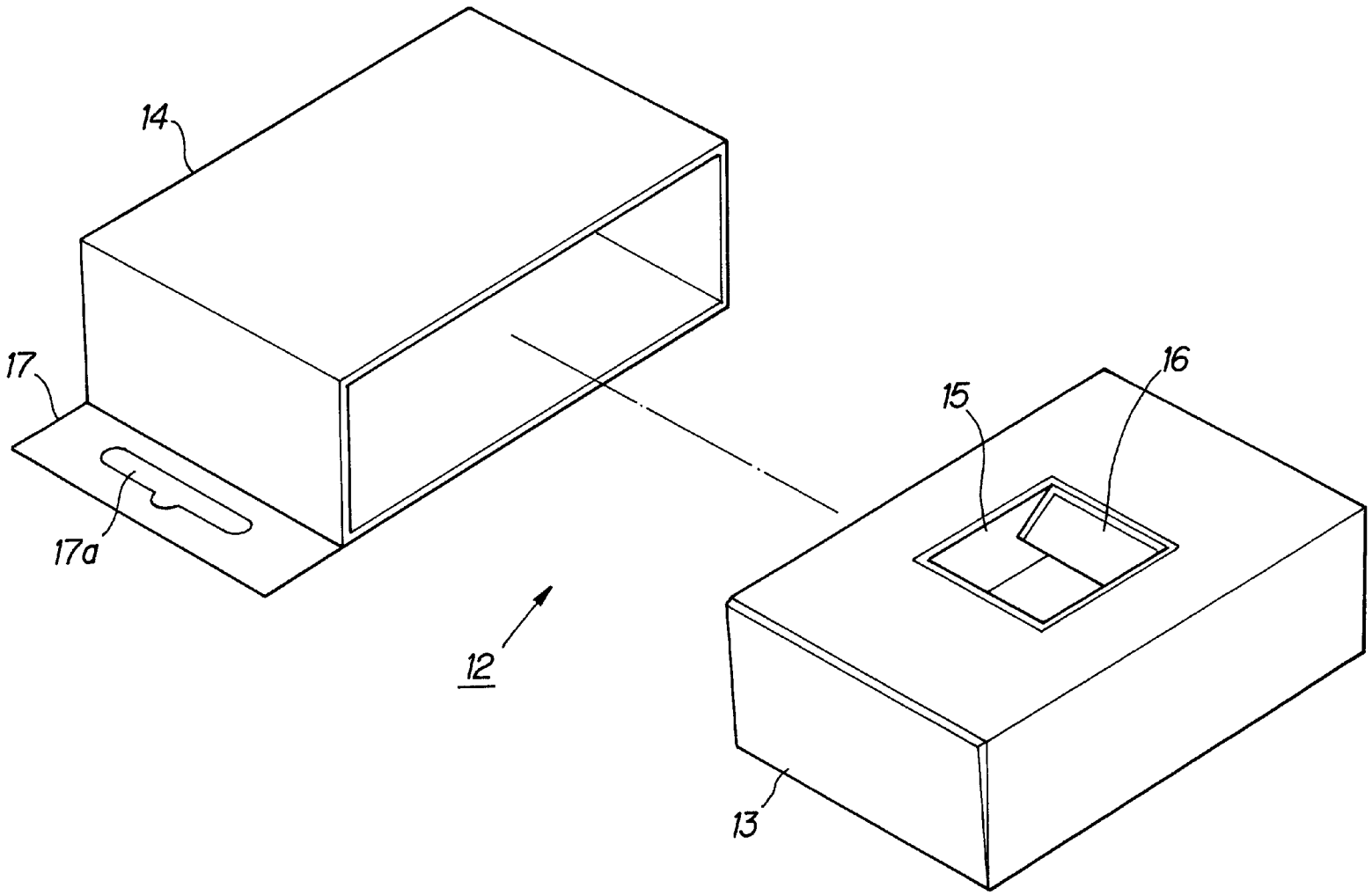
FIG. 6 is an exploded perspective view showing the wrapping case of the replenishing ink cartridge according to this another embodiment of the present invention.

As shown in FIGS. 4 and 6, the wrapping case 12 has an inner box 13 storing the tool set 18, the adapter 28, and the replenishing cartridge 5A, and an outer box 14 having two open side surfaces. The inner box 13 is removably fitted in the outer box 14. The inner box 13 has a foldable structure. Outer flaps are openably/closably arranged on the upper and lower portions of the rear surface plate of the inner box 13, and inner flaps are openably arranged on the upper and lower portions of the two side plates of the inner box 13. A square window 15 for supporting the printing cartridge 1A is formed at substantially the central portion of the surface of the inner box 13. Plate-like flaps 16 are openably arranged on the upper and lower end edge portions of the window 15. A hanging plate 17 extends upward from the upper portion of the rear surface plate of the outer box 14, and a hanging hole 17*a* is formed at substantially the central portion of the hanging plate 17.

Figure 7:
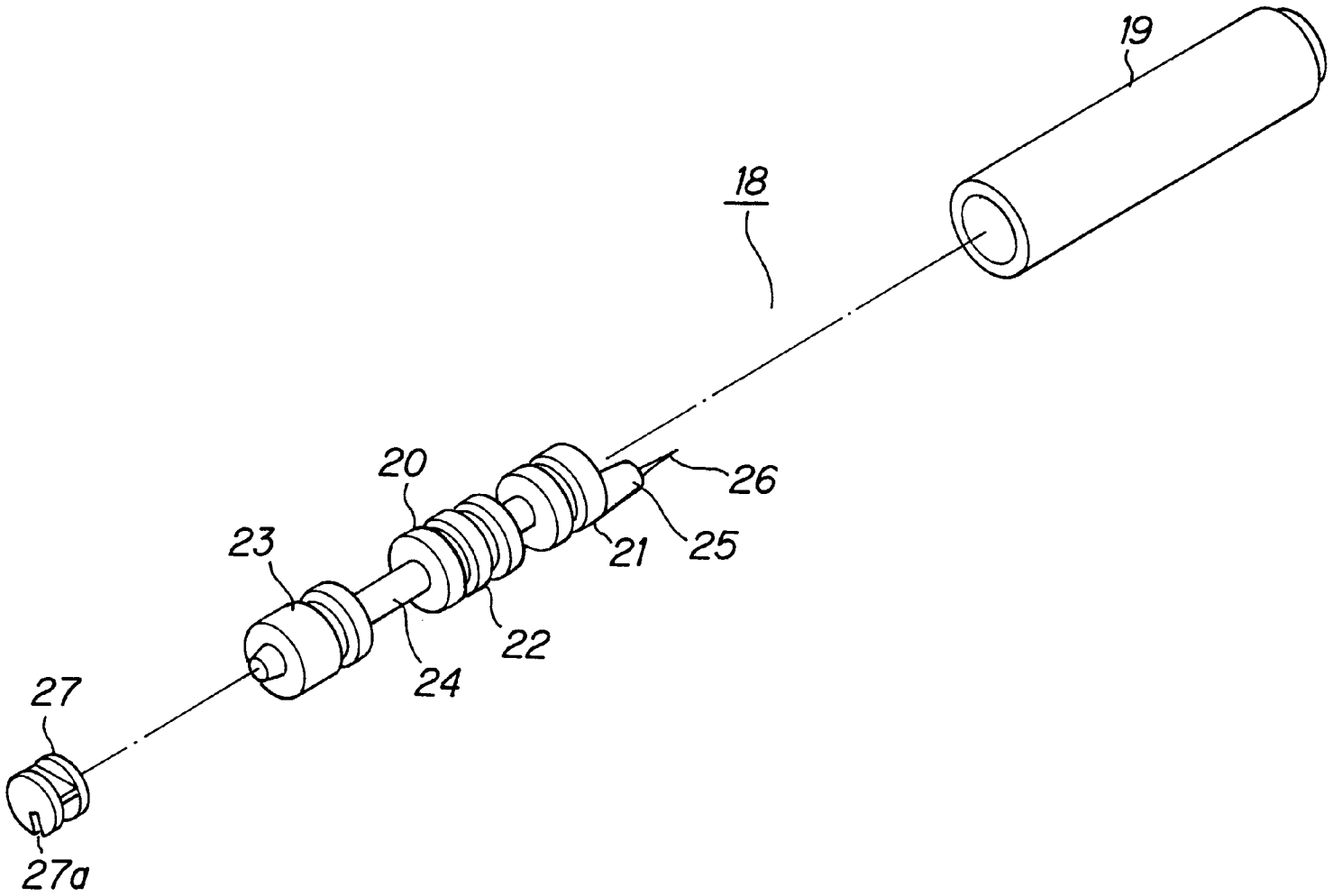
FIG. 7 is an exploded perspective view showing the tool set of the replenishing ink cartridge according to this another embodiment of the present invention.

The tool set 18 has a cap 19 made of a synthetic resin, and a tool jig 20 detachably fitted in the cap 19, as shown in FIG. 7. The cap 19 is formed basically cylindrically. One open end face of the cap 19 has a large diameter, and the other open end face thereof is substantially hemispherically arcuated to have a small diameter. The tool jig 20 has a distal end portion 21, a central portion 22 constituted by a plurality of circular disks, a proximal end portion 23, and a round rod-like connecting rod 24 for connecting the distal end portion 21, the central portion 22, and the proximal end portion 23. The distal end portion 21, the central portion 22, the proximal end portion 23, and the connecting rod 24 are integrally molded of various types of synthetic resins.

The distal end portion 21 is constituted by a pair of stacked circular disks. A support tip 25 is molded to project from the non-central portion of the surface of the circular disk at the front-most end of the distal end portion 21. An extracting pin 26 is mounted and supported on the support tip 25 by insertion. The proximal end portion 23 is constituted by a pair of stacked circular disks. An exchange cap 27 is pluckably supported at the central portion of the surface at the end-most end of the circular disk of the proximal end portion 23 through a thin liner. An atmosphere introduction groove 27*a* is formed in the exchange cap 27 to extend from the central portion outward in the radial direction.

Figure 8:
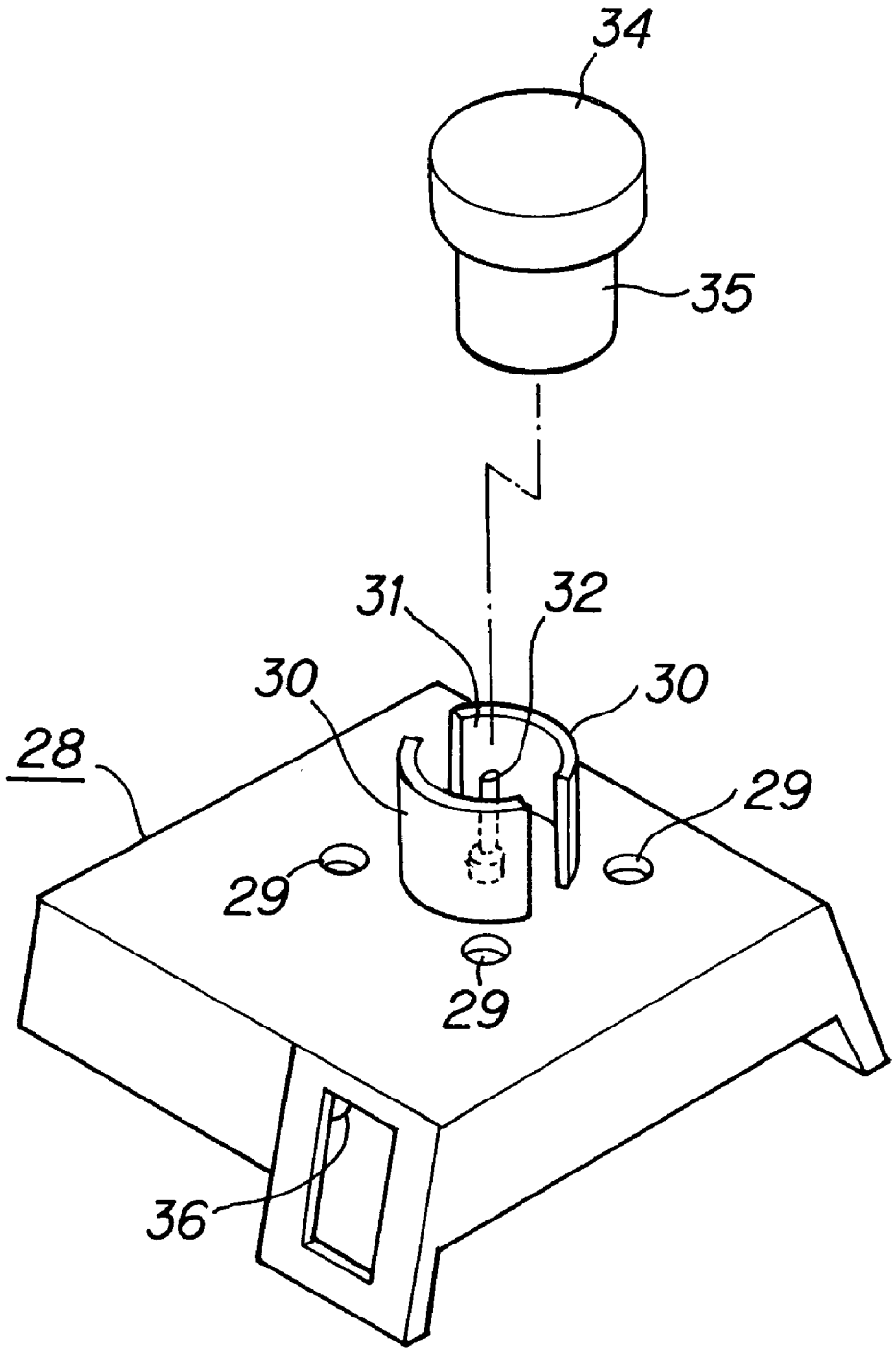
FIG. 8 is an exploded perspective view showing the adapter of the replenishing ink cartridge according to this another embodiment of the present invention.

As shown in FIG. 8, the adapter 28 is formed into a square lid by using various types of synthetic resins. A plurality of overflow through holes 29 are formed on the surface of the adapter 28 near its one side portion. A pair of guide walls 30 each having a substantially semiarcuated section are molded on the square region, partitioned by the plurality of overflow through holes 29, to stand upright at a gap from each other. The pair of guide walls 30 partition a substantially cylindrical fitting region 31. A communicating needle 32 is vertically supported at the central portion of the fitting region 31 by insertion, and the lower portion of the communication needle 32, which is covered, communicates with a first ink supply nozzle 33 (regarding this, see FIG. 5).

Figure 5:
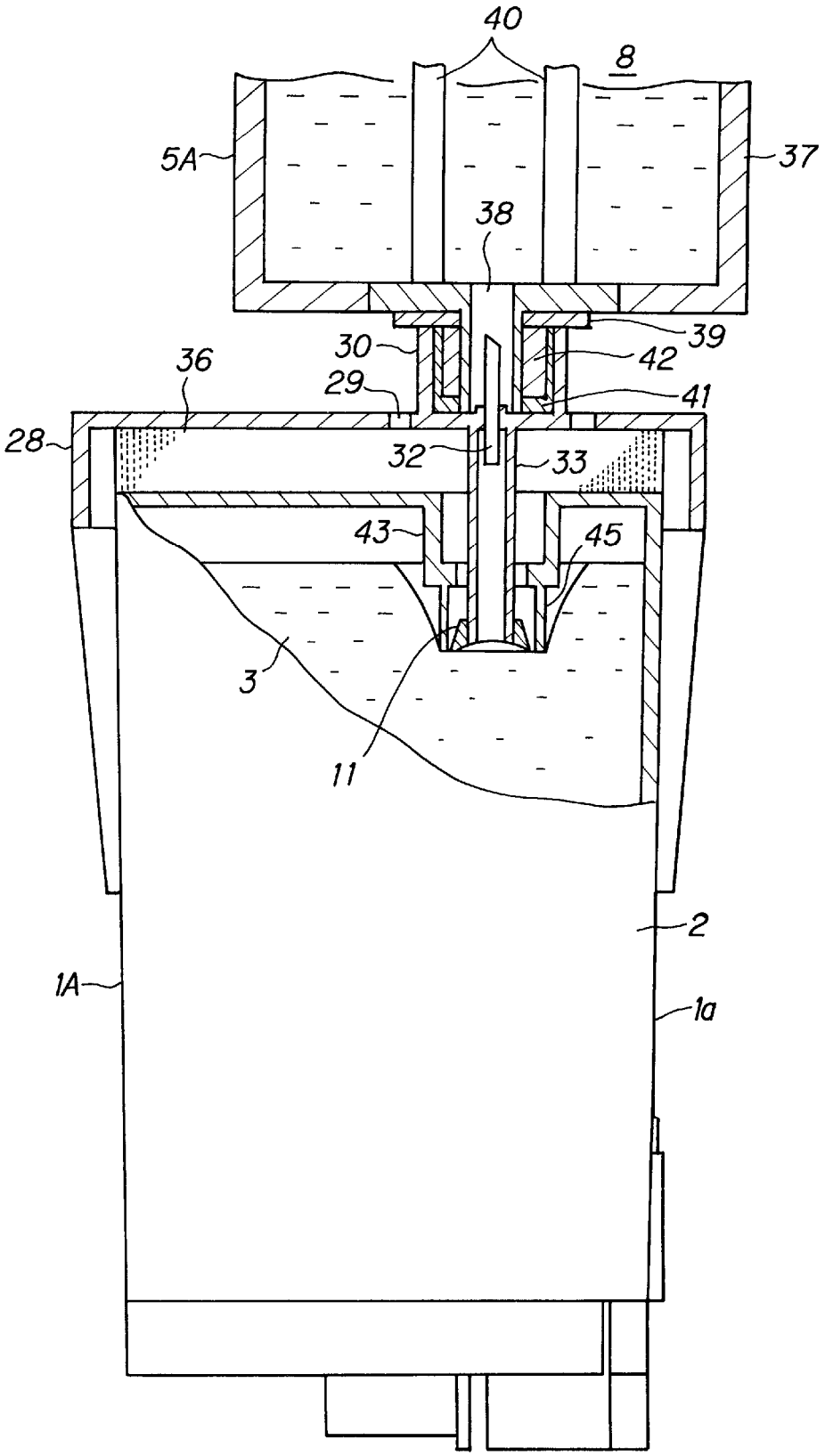
FIG. 5 is a cross sectional view showing the replenishing ink cartridge according to this another embodiment of the present invention.

As shown in FIG. 5, the upper portion of the first ink supply nozzle 33 is integrally molded vertically on the lower surface of the adapter 28, and the skirt-like press member 11 is fitted and mounted on the lower distal end portion of the first ink supply nozzle 33. As shown in FIG.8, a cylindrical sponge 35 of a protection cap 34 is fitted on the fitting region 31 when the sponge 35 is not in use. The sponge 35 protects the distal end of the communication needle 32. A substantially plate-like sponge 36 is adhered to the lower surface of the adapter 28 to cover the plurality of overflow through holes 29 and their peripheral portions.

As shown in FIGS. 4 and 5, the replenishing cartridge 5A has a square laminated pack 37 storing an ink 8. A second ink supply nozzle 38 is adhered to the center of the lower portion of the pack 37 through a mounting plate 39. Thin elongated plate ribs 40 for pack reinforcement extend upward from the two sides of the upper portion of the second ink supply nozzle 38. A substantially cylindrical fitting connector 41 is fitted and mounted on the lower portion of the second ink supply nozzle 38 through a cylindrical rubber member 42. The lower portion of the second ink supply nozzle 38 is detachably fitted on the communication needle 32 at the fitting region 31 through the fitting connector 41.

As shown in FIGS. 4 and 5, the printing cartridge 1A has a vertically elongated, hollow printing case 1*a* made of various types of synthetic resins, and an ink absorber 3 is stored in an ink storage chamber 2 in the case 1*a*. A cylindrical portion 43 is integrally molded on the surface of the case la near its one side portion to extend downward. This cylindrical portion 43 is pressed against the surface of the ink absorber 3. A plug 44 having the same size as the exchange cap 27 is fitted in the large-diameter upper opening portion of the cylindrical portion 43, and the small-diameter lower opening portion thereof is utilized as an atmosphere communicating hole 4. A small-diameter cylindrical portion 45 which is to be embedded in the ink absorber 3 is integrally molded on the outer peripheral edge of the lower surface of the cylindrical portion 43 to extend downward. The small-diameter cylindrical portion 45 is loosely fitted on the press member 11 to guide and protect it. Other portions are identical to those in the first embodiment, and a detailed description thereof will thus be omitted.

With the above arrangement, to replenish the printing cartridge 1A with the ink 8, first, the inner box 13 is removed from the outer box 14, and the inner box 13 is opened to extract the tool set 18, the adapter 28, and the replenishing cartridge 5A from it. After the tool set 18, the adapter 28, and the replenishing cartridge 5A are extracted, the pair of flaps 16 of the inner box 13 are pushed in to open the window 15. The lower portion of the printing cartridge 1A is vertically inserted in the window 15 to stabilize the posture of the printing cartridge 1A.

The tool jig 20 is removed from the cap 19 of the tool set 18, and the plug 44 on the surface of the printing cartridge 1A is removed with the extracting pin 26 to open the atmosphere communicating hole 4. The adapter 28 is placed on the upper portion of the printing cartridge 1A to insert the first ink supply nozzle 33 in the atmosphere communicating hole 4, and the distal end edge portion of the press member 11 is deeply inserted in the ink absorber 3 to be pressed against it. When the atmosphere communicating hole 4 and first ink supply nozzle 33 are caused to communicate with each other in this manner, the protection cap 34 is removed from the adapter 28, the fitting connector 41 is fitted between the pair of guide walls 30, and the lower portion of the second ink supply nozzle 38 is fitted on the communication needle 32, thereby completing preparation for the replenishing operation.

When the second ink supply nozzle 38 and the communication needle 32 communicate with each other, the ink 8 in the replenishing cartridge 5A sequentially passes through the second ink supply nozzle 38, the communication needle 32, and the first ink supply nozzle 33 from the pack 37 by its own weight and flows into the ink storage chamber 2 of the printing cartridge 1A. When replenishment of the ink 8 is completed in this manner, the adapter 28 may be removed from the printing cartridge 1A, the exchange cap 27 may be plucked off the proximal end portion 23 of the tool jig 20, and the upper opening portion of the cylindrical portion 43 of the printing cartridge 1A may be sealed.

In the above manner, the ink 8 can be continuously supplied at once with a simple arrangement, so that replenishment can be completed within a short period of time. Since the communication needle 32 is covered with the sponge 35 of the protection cap 34 when it is not in use, it will not damage the operator or other articles. Since the posture of the printing cartridge 1A is stabilized by utilizing the inner box 13 as the base, the printing cartridge 1A will not fall or become unstable at all, thereby achieving a smooth, effective operation.

Since the extracting pin 26 is protected with the cap 19 when it is not in use, the extracting pin 26 will not damage the operator or various types of articles at all in the same manner as described above, which is very safe. During the replenishing operation, since the ink 8 is replenished in a closed space, it will not soil the surrounding things. Even if the ink 8 should overflow, the sponge 36 absorbs the ink 8 and the ink 8 overflows from the plurality of overflow through holes 29, so that the ink 8 will not soil at all the upper portion of the printing cartridge 1A or portions other than the surface of the adapter 28. When replenishment of the ink 8 is ended, the plate ribs 40 in the pack 37 prevent the pack 37 from falling down or flexing. Inconveniences such as removal of the adapter 28 will not occur at all along with deformation of the pack 37.

This embodiment shows a prismatic bottomed ink storage chamber 2. However, the present invention is not limited to this, and an ink storage chamber 2 having another shape, e.g., a cylindrical bottomed ink storage chamber 2, may also be employed instead. The size, arrangement, material, and the like of the replenishing cartridges 5 and 5A can be changed as required as far as no problems occur in storing the ink 8. For example, the replenishing cartridges 5 and 5A may be flexible containers instead of bags.

The ink supply nozzle 6 and the first and second ink supply nozzles 33 and 38 can be formed at least partly long or semi-transparent. The press member 11 may be integrally molded with the ink supply nozzle 6 or first ink supply nozzle 33, or may be attached to it as a separate component. Phenolic resin or the like may be used as required in place of the sponge 35 or 36. Other articles, e.g., a gauze, a sponge, or a cloth that are similar may also be stored in the inner box 13. One or a plurality of through holes may be formed in the exchange cap 27 as required to introduce the atmosphere into the printing cartridge 1 or 1A, as a matter of course.

As has been described above, according to the present invention, when replenishing the printing cartridge, having the ink absorber made of the porous body or fiber bundle stored in the ink storage chamber, with the ink, the cumbersome operation of replenishing the ink little by little, while making sure that the ink will not overflow, can be avoided. Once the replenishing cartridge is set to the printing cartridge, no trouble occurs even if the printing cartridge is left until replenishment is complete. Since replenishment is performed by merely causing the press member to come into contact with the ink absorber, the function of the ink absorber will not be impaired. Since ink replenishment is performed within a closed space, the ink will not soil the surrounding things, thus achieving cleanliness.

What is claimed is:

1. An ink cartridge for replenishing a printing cartridge with an ink, wherein the printing cartridge has an ink storage chamber defined by a wall, the ink storage chamber contains an ink absorber made of a porous body or fiber bundle and the wall defines an access hole providing fluid communication between the ink storage chamber and the atmosphere, the ink cartridge comprising:

an ink container;

an ink supply nozzle having a proximal end connected to said ink container and a distal end dimensioned to be received through said access hole, the distal end dimensioned to be substantially smaller than said access hole such that an air gap is formed between a perimeter of said access hole and said distal end when said distal end is received through said access hole, said nozzle defining a lumen from the proximal end to the distal end, the lumen in fluid communication with the ink container at the proximal end, the lumen opening outwardly at the distal end; and a funnel-shaped pressing member having a narrow end attached to the distal end of said nozzle and having a wide end broader than said distal end of said nozzle, said wide end extending distally beyond the distal end of said nozzle, the wide end dimensioned to pass through the access hole and adapted to contact said ink absorber when said distal end of said nozzle is received through said access hole.

2. The ink cartridge of claim 1 wherein the narrow end of the pressing member is attached annularly about the distal end of the ink supply nozzle.

3. The ink cartridge of claim 1 wherein the ink container is a rigid container.

4. The ink cartridge of claim 1 wherein the ink container is a flexible bag.

5. The ink cartridge of claim 1 wherein the proximal end of the nozzle is connected to a bottom end of the ink container.

6. The ink cartridge of claim 5 wherein the nozzle extends vertically and downwardly from the bottom end of the ink container.

7. The ink cartridge of claim 1 wherein the wide end of the pressing member extends beyond the distal end of the nozzle a distance and with an opening angle adapted to contact and compress an annular portion of the ink absorber sufficiently to prevent lateral escape of the ink supplied through the nozzle.

8. The ink cartridge of claim 7 wherein the distance and the opening angle of the wide end of the pressing member are adapted to permit the distal end of the nozzle to contact a second portion of the ink absorber defined within the annular portion such that the ink can flow freely through the second portion into the ink absorber.

* * * * *